US005447379A

United States Patent [19]

Pou

[11] Patent Number: 5,447,379

[45] Date of Patent: Sep. 5, 1995

[54] PORTABLE TAG OR LABEL PRINTER

[75] Inventor: Frederick M. Pou, Kettering, Ohio

[73] Assignee: Monarch Marking Systems, Inc., Dayton, Ohio

[21] Appl. No.: 332,417

[22] Filed: Oct. 31, 1994

[51] Int. Cl.[6] ..... B41J 3/36

[52] U.S. Cl. ..... 400/88; 400/55; 400/120.01; 400/120.16; 347/220; 347/222

[58] Field of Search ..... 101/88, 55, 56, 288, 101/120.01, 120.16, 120.17; 346/76 PH

[56] References Cited

U.S. PATENT DOCUMENTS

| | | | |
|---|---|---|---|
| 4,264,396 | 4/1981 | Stewart | 101/288 |
| 4,868,676 | 9/1989 | Matsuura et al. | 400/88 |
| 5,015,324 | 5/1991 | Goodwin et al. | 101/288 |
| 5,092,688 | 3/1992 | Haennelt et al. | 400/88 |
| 5,149,210 | 9/1992 | Eriksson | 400/56 |
| 5,157,415 | 10/1992 | Seyasu | 400/120.17 |
| 5,163,766 | 11/1992 | Fushimi et al. | 400/88 |
| 5,176,458 | 1/1993 | Wirth | 400/56 |
| 5,198,836 | 3/1993 | Saito et al. | 346/76 PH |
| 5,267,800 | 12/1993 | Petteruti et al. | 400/88 |

*Primary Examiner*—Eugene H. Eickholt
*Attorney, Agent, or Firm*—Joseph J. Grass

[57] ABSTRACT

There is disclosed a portable printer for printing on either tags or labels. Its print head assembly includes a thermal print head, a platen roll. The printer has a housing with front, rear and top portions, a single horizontal printed circuit board, and a vertically extending battery pack which is releasably attached to the rear portion and is directly plug-connectable to the circuit board. The print head assembly, a peel roller and a releasable presser roll are located at the front portion of the housing. The print head assembly includes a spring arrangement for urging the print head into pressure contact with the platen roll. The spring arrangement has main springs and an auxiliary spring. The auxiliary spring bears against the housing and the print head assembly.

7 Claims, 6 Drawing Sheets

FIG-3
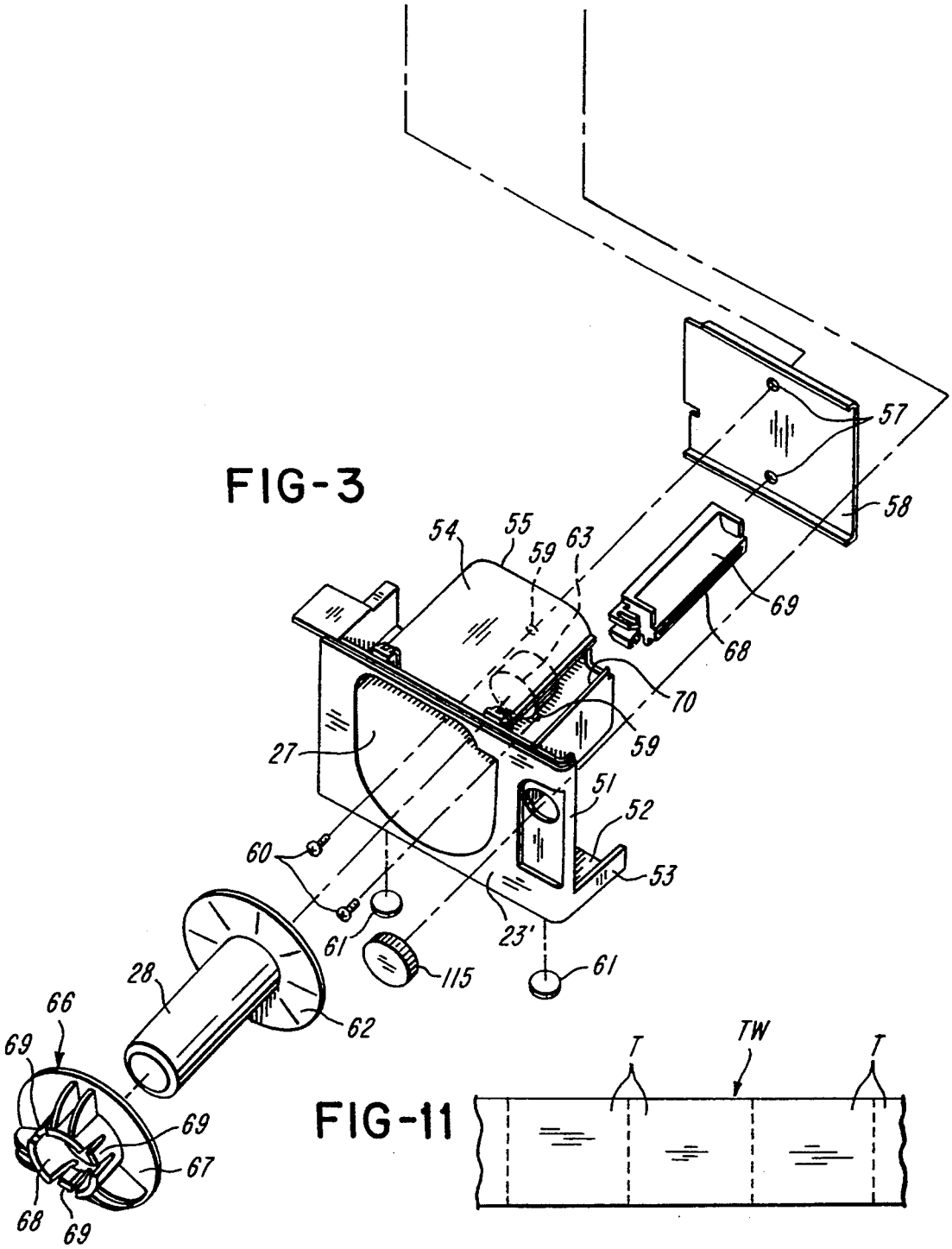
FIG-11
FIG-12
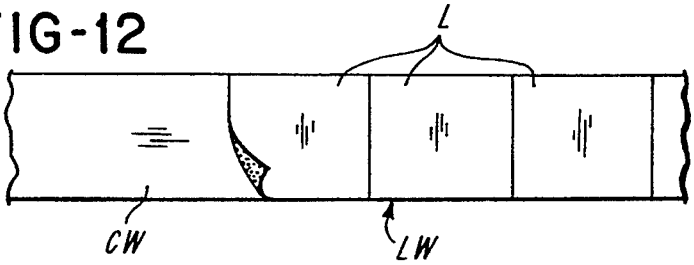

PORTABLE TAG OR LABEL PRINTER

BACKGROUND OF THE INVENTION

1. Field of the Invention

This invention relates to the printing art.

2. Brief Description of the Prior Art

The following patent documents are made of record: U.S. Pat. No. 4,264,396; U.S. Pat. No. 5,015,324; U.S. Pat. No. 5,267,800; and European patent application 0 449 236.

SUMMARY OF THE INVENTION

The invention relates to an improved, compact, easy-to-manufacture, portable printer capable of achieving quality printing results on webs of either tags or labels.

The printer has a housing with front and rear portions. There is a printed circuit board inside the housing which mounts manually operable switches. A battery pack attached to the rear portion is plug connectable to the circuit board. A print head assembly is mounted at the front portion of the housing. The print head assembly includes a thermal print head which cooperates with a platen roll and a peel roller for delaminating pressure sensitive labels from a carrier web. A spring arrangement acts on the print head assembly to provide effective pressure for printing on either a tag web or a composite label web.

BRIEF DESCRIPTION OF THE DRAWINGS

FIG. 3 is an exploded perspective view, to be taken together with FIG. 2, which shows an additional portion of the printer;

FIG. 11 is a fragmentary view of a web of tags; and

FIG. 12 is a fragmentary view of a composite web of labels.

DETAILED DESCRIPTION OF THE PREFERRED EMBODIMENT

Figure 1:
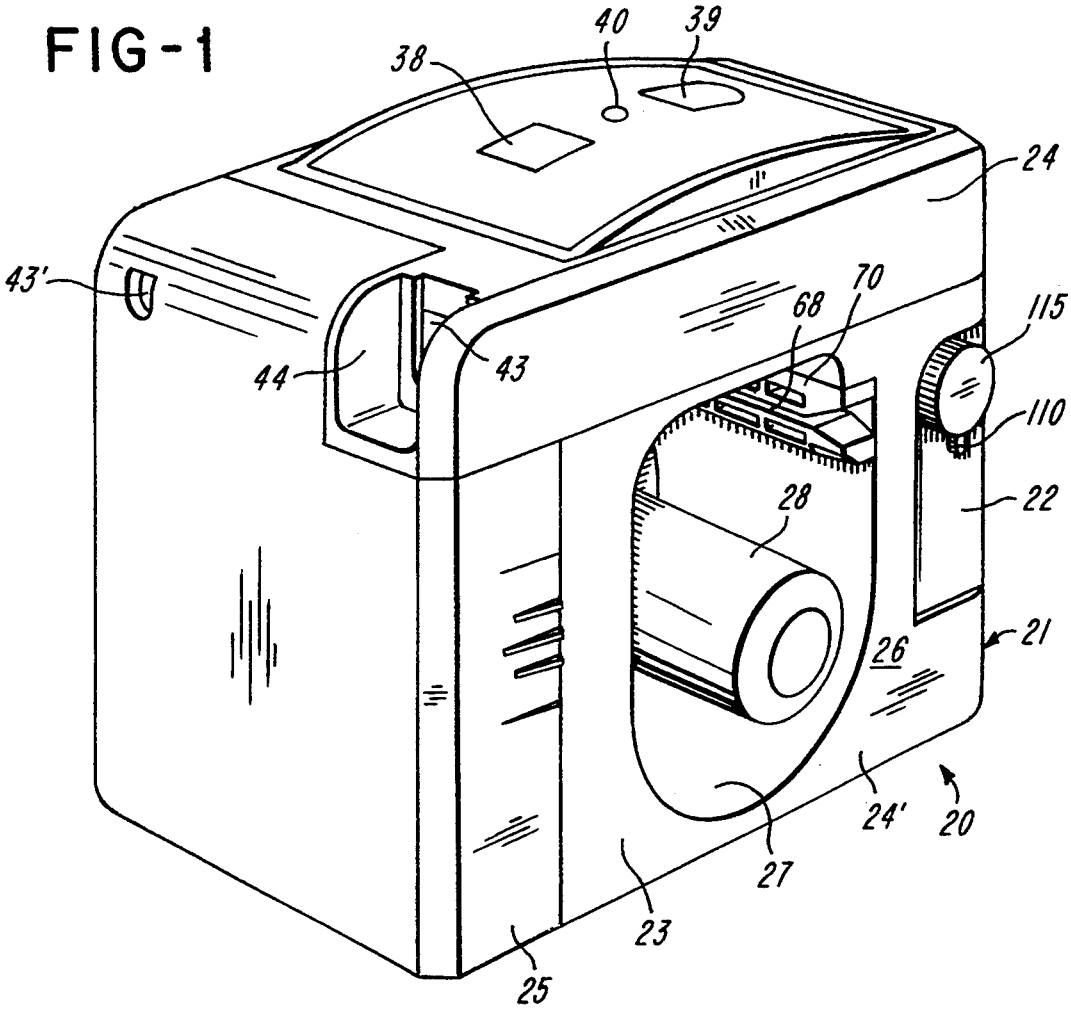
FIG. 1 is a perspective view of a portable printer embodying the invention.
Figure 4:
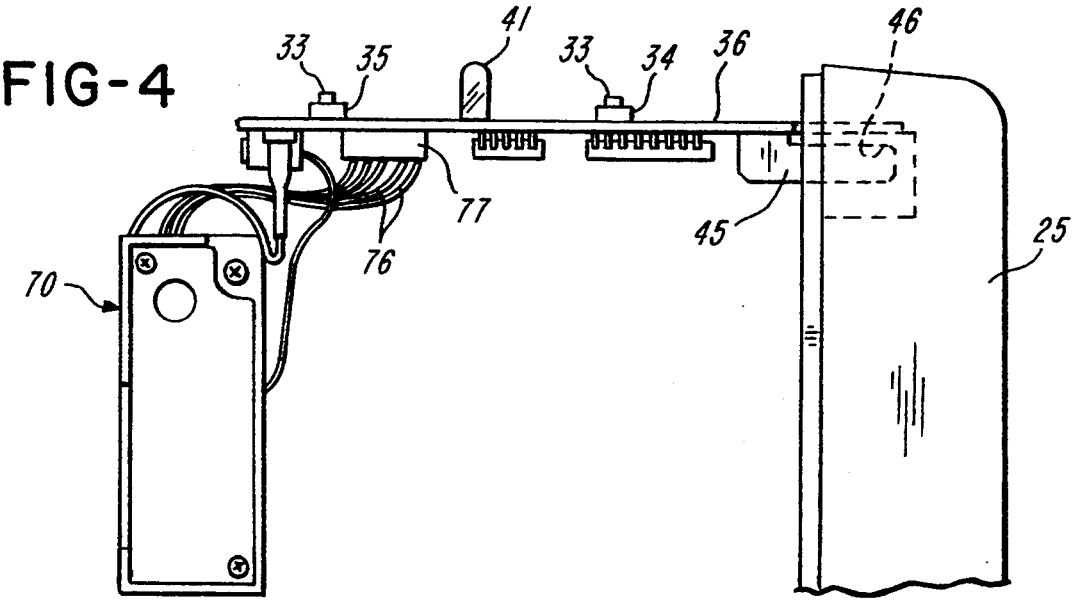
FIG. 4 is an elevational view showing the print head assembly and the battery pack connected to the printed circuit board.

Referring to FIG. 1, there is shown a portable printer generally indicated at 20 having a housing 21. The housing 21 has a front portion 22, a rear portion 23, a top portion 24 and a bottom portion 24'. A rechargeable battery pack 25 is suitably releasably attached to the rear portion 23. A side wall 26 opens into a cavity 27. A hub 28 in the cavity 27 can mount a roll R (FIG. 5) of either a tag web TW (FIG. 11) or a composite label web LW (FIG. 12).

Figure 2:
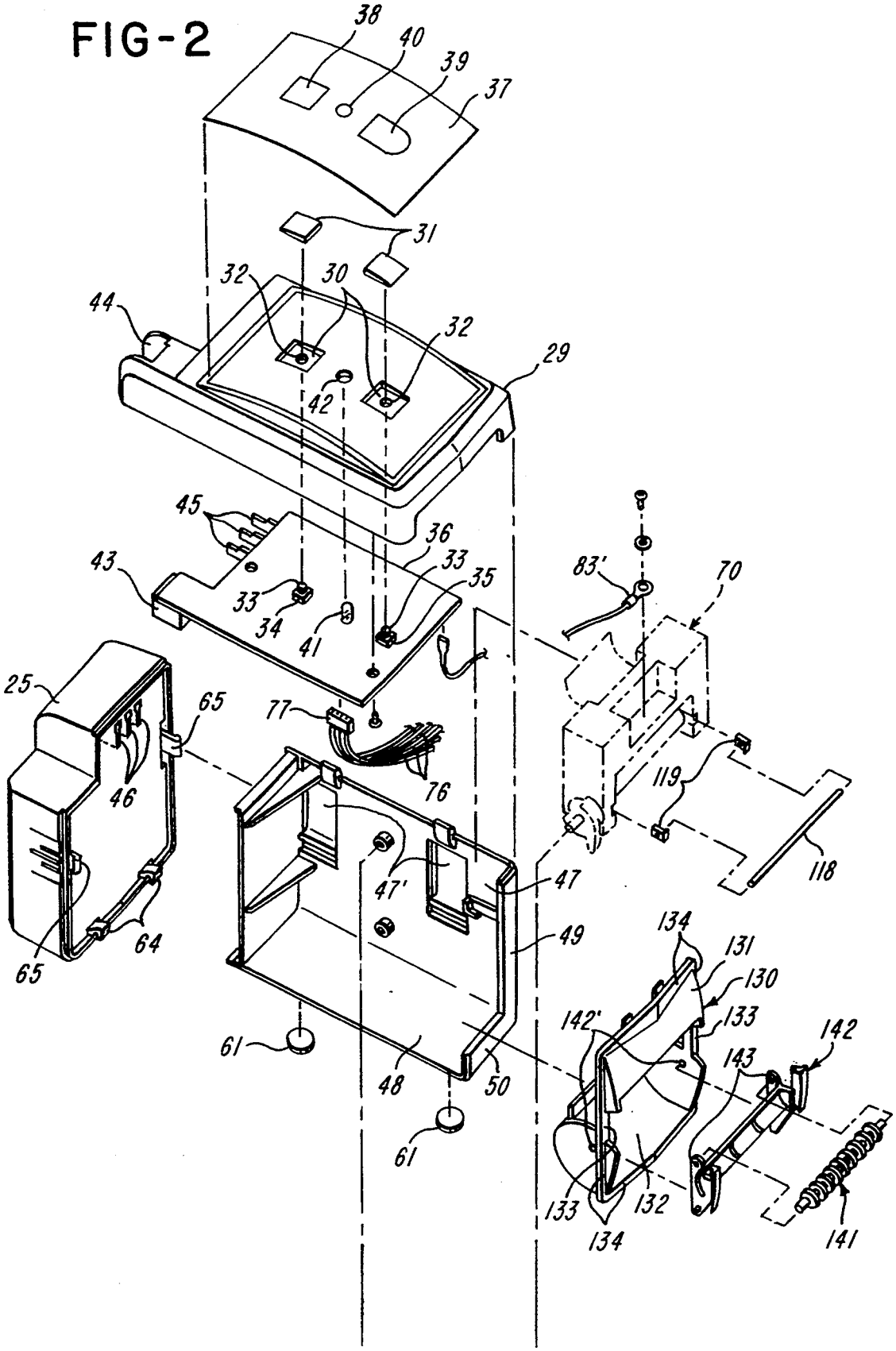
FIG. 2 is an exploded perspective view of a portion of the printer shown in FIG. 1.

As shown in FIG. 2, the top portion 24 is comprised of a molded plastics section 29 having recesses 30 for receiving blocks 31. There are holes 32 in the recesses 30 through which buttons 33 of switches 34 and 35 extend. The switches 34 and 35 are mounted on a printed circuit board 36. A plate 37 received on and adhered to the section 29 has flexible portions or pads 38 and 39 and a translucent portion or window 40. The circuit board 36 has a light emitting diode 41 which extends into a hole 42 in the section 29. The switch 34 is an on-off switch. When the pad 38 is manually depressed, the associated block 31 is depressed to act on the associated button 33 to close the switch 34, thereby turning the printer "on". This causes the diode 41 to light up, and the light to be visible through the window 40. When it is desired to feed a tag T or label L, the pad 39 is depressed which causes the associated block 31 to be depressed to act on the associated button 33 to close the switch 35, to thereby initiate a feeding cycle. Printing occurs when the appropriate signal is received through a communications port 43. The single circuit board 36 which mounts all the control circuitry is shown to mount the communications port 43 accessible through an opening 44 in the section 29. The circuit board 36 also mounts three electrical connectors 45 adapted to coupling within three connectors 46 of the battery pack. This direct connection of the switches 34 and 35, the diode 41, the port 43 and the connectors 45 obviates the need for wires and additional soldering of connectors. The battery 25 has a charging port 43'.

A vertical side panel 47 is joined with a horizontal base panel 48. The panel 47 includes two integrally molded clips 47' adapted to be received on the user's belt. The panel 47 has a flange 49 joined to a flange 50 on the bottom panel 48. A vertical side panel 23' (FIG. 3) has a flange 51, and a base panel 52 joined to the side panel 23' has a flange 53 joined to the flange 51. The cavity 27 is defined by a horizontal wall portion 54 and a vertical wall portion 55. Screws 60 (FIG. 3) extend through holes 59 in the wall portion 55 and holes 57 and are threadably received in the panel 47. The base portions 48 and 52 each have feet 61.

Figure 5:
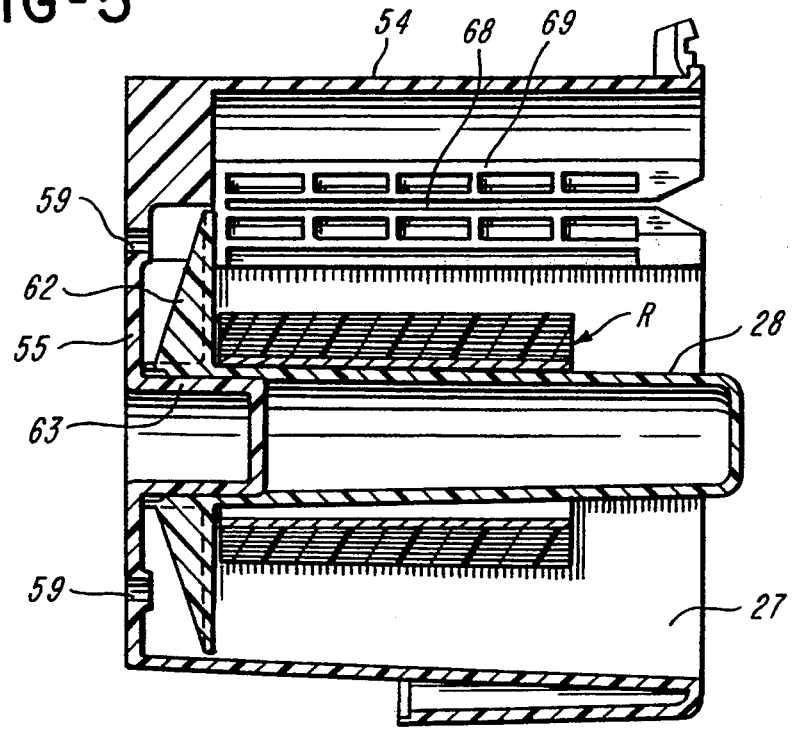
FIG. 5 is an assembled sectional view of certain components shown in FIG. 3, with a roll of labels.

The hub 28 has a flange 62. The hub 28 is hollow and is pressed-fitted over a stud 63 on the wall portion 55 as best shown in FIG. 5.

The battery pack 25 has hooks 64 which releasably engage in notches (not shown) in the base portions 48 and 52 and resilient snaps 65 which releasably engage in recesses (not shown) in the side panels 23' and 47.

FIG. 3 shows a keeper 66 having a flange 67 joined to a generally tubular portion 68. The tubular portion 68 includes three resilient fingers 69 which can grip the hub 28. The roll R is received on the hub 28 as shown in FIG. 5. The roll R is positioned between the flanges 62 and 67. The keeper 66 has been omitted in FIG. 5. The roll R is loaded by sliding the roll R onto the hub 28. The free end of the web (either a tag web TW or a composite label web LW) can be inserted into a slot 68 of a guide 69. The guide 69 is mounted in an opening 70 in the wall portion 54.

Figure 10:
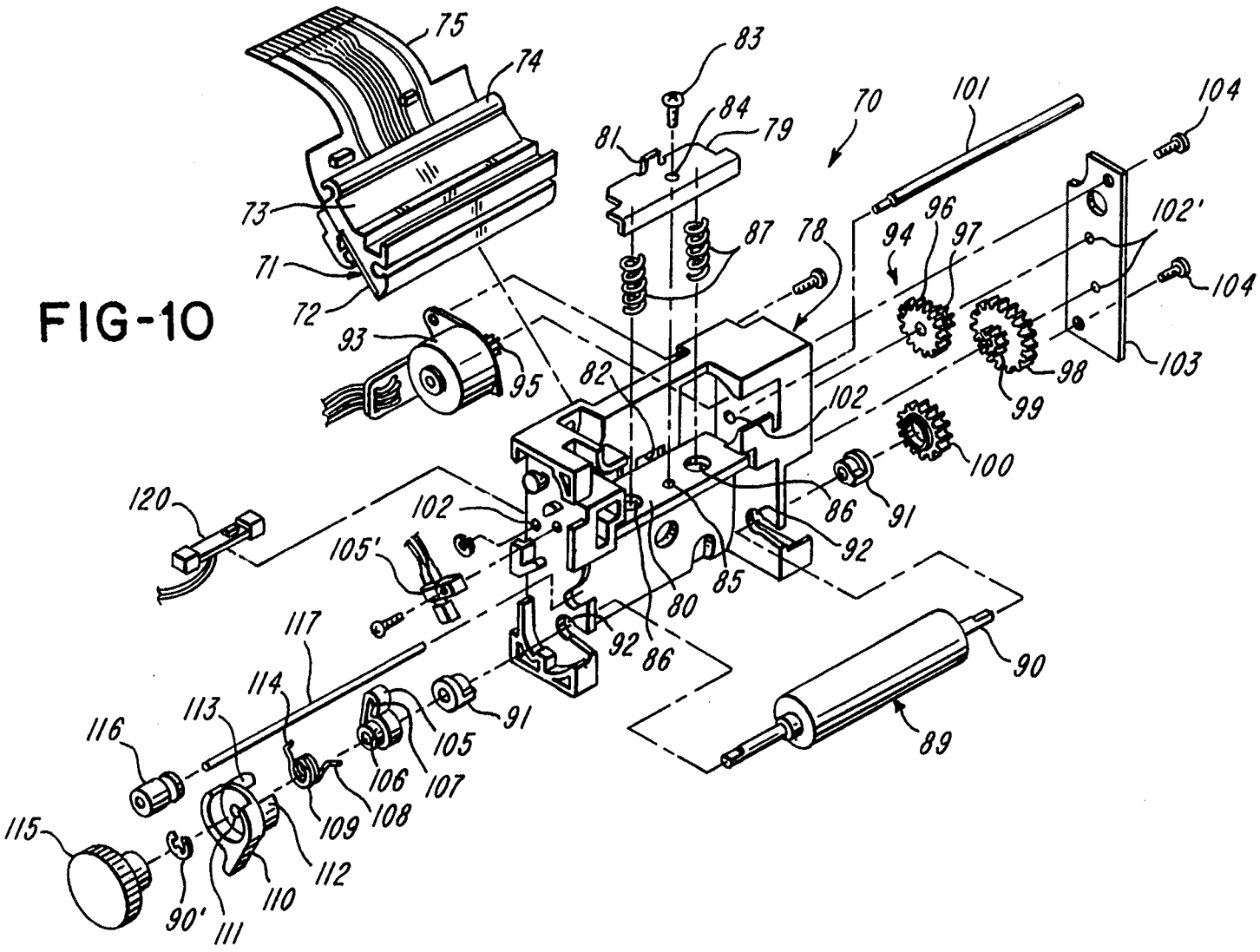
FIG. 10 is an exploded perspective view of the print head assembly.

A print head module or print head assembly generally indicated at 70 is shown in FIG. 10. The print head assembly 70 includes a print head subassembly generally indicated at 71. The print head subassembly 71 includes a thermographic or thermal print head 72 having preferably a straight line of printing elements and further includes a movable mounting member 73 to which the print head 72 is secured. The mounting member 73 has an elongate C-shaped portion 74. The print head 72 is joined to a ribbon connector 75 which in turn is connected to a plurality of wires 76. The wires 76 are connected to a plug connector 77 which is plug-connected to the circuit board 36. There are nine wires 76 although a lesser number are illustrated.

Figure 9:
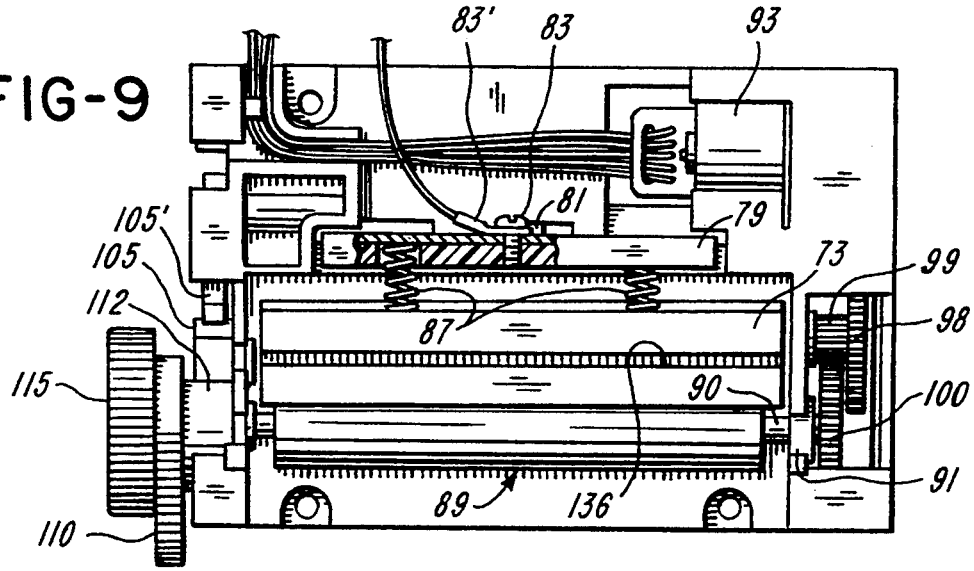
FIG. 9 is a front elevational view, partly in section, showing certain components of the print head assembly.

The assembly 70 includes a mounting block generally indicated at 78. A plate 79 is secured to a shelf 80 of the mounting block 78. A retainer 81 on the plate 79 fits through an opening 82 in the mounting block 78 and helps capture the plate 79. A screw 83 passes through a grounding connector 83' (FIGS. 2 and 9) and a hole 84 in the plate 79 and is threaded into a hole 85 in the shelf 80. The shelf 80 has two enlarged holes 86 through which compression springs 87 can pass freely. The springs 87 which are under compression bear against the underside of the plate 79 and against a surface 88 (FIG. 6) on the mounting member 73.

A platen roll generally indicated at 89 includes a shaft 90 having a transversely extending axis 89'. The shaft 90 is received in bearings 91 (FIG. 10) retained in cutouts 92. The platen roll 89 is driven by an electric motor 93 through gearing 94. The gearing 94 includes a gear 95 on the motor 93. The gear 95 meshes with a gear 96. A gear 97 is secured to the gear 96. The gear 97 meshes with a gear 98. A gear 99 is secured to the gear 98 and meshes with a gear 100. The gear 100 is secured to the shaft 90.

Figure 6:
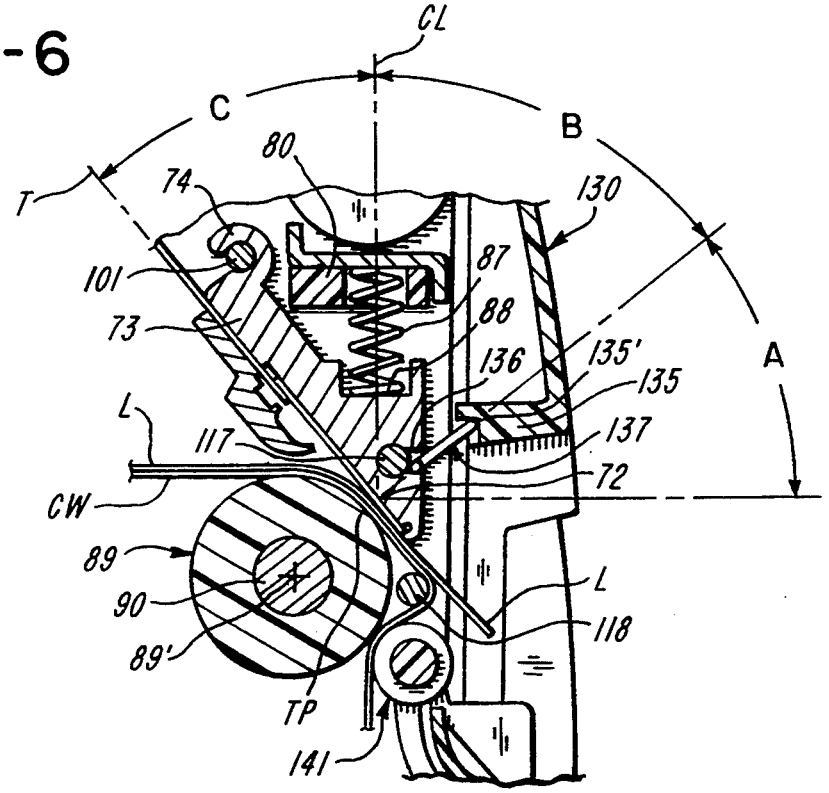
FIG. 6 is a fragmentary sectional view of the print head assembly, the housing, the peel roller and a presser roll.

A rod 101 received in aligned holes 102 passes through the C-shaped portion 74. The rod 101 extends parallel to the axis 89'. The rod 101 thus pivotally mounts the print head subassembly 71. The springs 87 urge the print head assembly 71 clockwise about the rod 101 and into printing cooperation with the platen roll 89 as best shown in FIG. 6.

Referring to FIG. 10, the gears 96 and 97, and 98 and 99 are shown to be rotatable on pins (not shown) received in holes 102' in a plate 103. The plate 103 is secured to the mounting block 78 by screws 104.

An actuator 105 has a hub 106 freely pivotable on the shaft 90. The actuator 105 has a recess 107 for receiving one arm 108 of a spiral spring 109. The spring 109 is received on the hub 106. An operating lever 110 which is freely pivotable on the shaft 90 has a hole 111 for receiving the shaft 90. The lever 110 has a cam 112 and a projection 113 which straddle the spring 109. The other arm 114 of the spring 109 exerts a counterclockwise force against the projection 113 (as viewed in FIG. 10). An E-ring 90' received on the shaft 90 holds the actuator 107, the lever 110 and the spring 109 in assembled relationship. A knob 115 secured to the shaft 90 enables the shaft 90 and hence the platen roll 89 to be manually rotated. The counterclockwise rotation of the lever 110 (FIG. 10) causes the cam 112 to drive a follower roller 116 and a rod 117 upwardly to raise pivot the print head subassembly 71 counterclockwise so that the print head 72 is moved away from the platen 89. The rod 117 is received in a recess or groove 136 in the mounting member 73. The groove 136 extends transversely and parallel to the axis 89'. This enables either a tag web TW or a label web LW to be threaded through the printer 20. The actuator 105 is moved by the cam 112 to open a switch 105' when the lever 110 is pivoted counterclockwise, thereby disabling the printer during such time as the print head 72 and the platen roll 89 are separated.

The print head assembly 70 to the extent described in detail above is commercially available from a third party. However, as purchased, that assembly 70 does not include any peel roller for delaminating pressure sensitive labels L from the carrier web CW. Accordingly, a peel roller 118 (FIGS. 2 and 6) is provided to delaminate a printed label L from the carrier web CW. The peel roller 118 is rotatably mounted on blocks 119 received in the cutouts 92 in the mounting block 78. The mounting block 78 also mounts a sensor 120 which senses the presence or absence of a tag web TW or label web LW.

Figure 7:
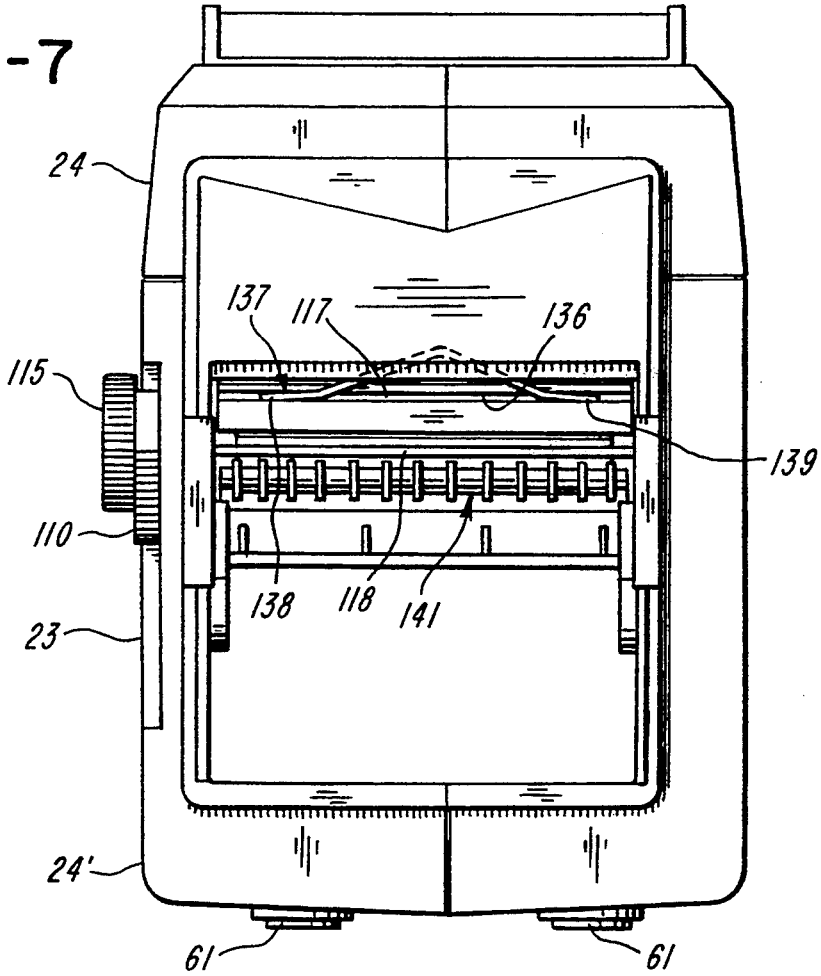
FIG. 7 is a front elevational view of the printer, with certain parts omitted for clarity.
Figure 8:
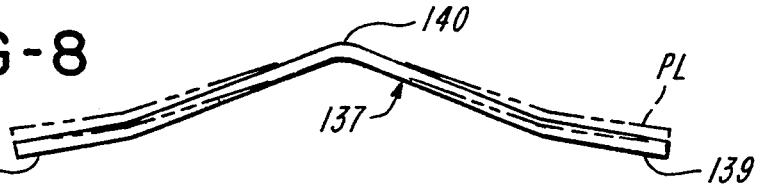
FIG. 8 is an elevational view of a spring, in both its free state and its loaded state.

As viewed in FIGS. 2 and 6, there is shown a front panel generally indicated at 130 which includes an upper or transverse portion 131 and a lower generally arcuate portion 132 joined by generally vertical connecting portions 133. The front panel 130 has a flat face or marginal edge 134 which extends all the way around the front panel 130. The marginal edge 134 bears against the flanges 49, 50, 52 and 53 at the inside of the housing 21. As shown in FIG. 6, the front panel 130 is provided with a generally horizontal shelf or flange 135 with a recess 135'. A spring 137 is received in the recesses 135' and 136. In the illustrated embodiment, the spring 137, also shown in FIGS. 7 and 8, preferably takes the form of a round leaf spring which has been bent into a generally V-shaped configuration. In FIG. 8, the spring 137 is shown by solid lines in its free state before being inserted into the recesses 135' and 136 and by phantom lines PL in its flexed state as it would appear when it has been inserted in the recesses 135' and 136'. End portions 138 and 139 of the spring 137 are received in the recess 136 and a central portion 140 at the vertex of the "V" is received in the recess 135'.

The straight line of printing elements of the print head 72 cooperates with the platen roll 89 at a tangent point TP along a tangent T to the outer surface of the platen 89 as shown in FIG. 6. The springs 87 extend at a shallow acute angle C with respect to the tangent T. Thus, only a small portion of the forces exerted by the springs 87 is actually effective to press the print head 72 against the platen 89. However, the forces exerted by the springs 87 at this acute angle are sufficient to cause adequate printing pressure against labels L of the composite label web LW to enable quality printing to occur.

The springs 87 are sufficient by themselves to print on composite webs of pressure sensitive labels which are relatively flexible and thus conform to the path shown in FIG. 6. However, it has been found that because of the stiffness of tag webs the force of the springs 87 alone is insufficient to cause the proper printing pressure to be exerted on the tag web. It has been found that by adding the spring 137, the printing pressure is sufficient for providing quality printing on tag webs TW, without providing excessive printing pressure when printing on composite label webs LW. Thus, the arrangement of springs 87 and 137 has been found to enable quality printing on both tag webs TW and label webs LW.

As shown, the spring 137, which may be termed an auxiliary spring, exerts additional or auxiliary force along a line essentially perpendicular to the tangent T at the tangent point TP. In the preferred embodiment, the force exerted by the spring 137 is slight compared to the forces exerted by the springs 87. The springs 87 are shown to exert their forces vertically as seen in FIG. 6 and urge the mounting member 73 about the rod 101.

By way of example, not limitation, angle A of inclination of the spring 137 is about 40° with respect to the horizontal. The distance measured along the tangent T between the center of the rod 101 to the printing elements which are located at the tangent point TP is about 0.8 inch, the distance between the recesses 135' and 136 is about 0.285 inch. The angle B between the spring 137 and the centerline plane CL of the springs 87 is about 50° and the angle C between the tangent T and the centerline CL is about 40°.

As shown in FIG. 6, the composite label web LW is shown to pass between the print head 72 and the platen roll 89 at a printing position coincident with the tangent point. TP. The printing elements of the print head 72 are disposed at the tangent point TP. Downstream of the printing position, the carrier web CW makes a bend as it passes partially around the peel roller 118 which causes delamination of the leading label L from the carrier web CW. Downstream of the peel roller 118 the carrier web CW is pressed into contact with the surface of the platen roll 89 by a grooved pressure roll 141. The pressure roller 141 is rotatable mounted on a frame 142 (FIG. 2) which is pivotally mounted at its lower end portion in transversely aligned holes 142'. The roller 141 is mounted in holes 143 in the frame 142. The frame 142 is retained in its operating position by snaps but is releasable which allows the frame 142 to pivot clockwise as seen in FIG. 2.

Other embodiments and modifications of the invention will suggest themselves and modifications of the invention will suggest themselves to those skilled in the art, and all such of these as come within the spirit of this invention are included within its scope as best defined by the appended claims.

I claim:

1. A printer for printing on a web of either tags or labels, comprising: a platen roll, a thermographic print head cooperable with the platen roll at a printing position, a movable mounting member for a print head, first means for urging the mounting member and the print head toward the printing position, the first means being sufficiently strong to provide adequate pressure between the print head and the platen roll for printing on a composite web of labels, second means for urging the mounting means and the print head toward the printing position, and the second means providing sufficient auxiliary pressure between the print head and the platen roll for printing on a composite web of tags.

2. A printer for printing on a web of either tags or labels, comprising: a platen roll, a thermographic print head cooperable with the platen roll at a printing position at a tangent point along a tangent of the platen roll, a mounting member for the print head, a pivot for pivotally mounting the mounting member, spring means including a first spring for urging the mounting member and the print head about the pivot toward the printing position, the first spring means acting on the mounting member at an acute angle relative to the tangent, means including a second spring for urging the mounting member and the print head about the pivot toward the printing position, and the second spring means acting on the mounting member at an angle greater than the acute angle.

3. A printer as defined in claim 2, wherein the first spring is a compression spring, and the second spring has a generally V-shaped configuration.

4. A printer as defined in claim 2, the platen roll having an axis, wherein the mounting member has a transverse groove extending generally parallel to the axis; wherein the second spring is generally V-shaped and includes a portion received in the groove.

5. A printer for printing on a composite web of either tags or labels, comprising: a print head assembly including a mounting block, a platen roll rotatably mounted on the mounting block, and a print head subassembly; means for pivotally mounting the print head subassembly to the mounting block; the print head subassembly including a thermographic print head cooperable with the platen roll at a printing position; the print head assembly including a first spring acting in one direction on the print head subassembly for urging the print head toward the printing position, and a second spring acting in different direction on the print head subassembly for urging the print head toward the printing position.

6. A printer as defined in claim 5, including a housing for the print head assembly, wherein the second spring bears against the housing.

7. A printer for printing on a web of either tags or labels on a carrier web, comprising: a housing having a front portion and a rear portion, a generally vertical battery pack releasably connected to the rear portion of the housing, the battery pack having electrically connectors, a generally horizontal printed circuit board within the housing, electrical connectors rigidly secured to the circuit board for plug-connecting with the connectors of the battery pack, a mounting member for the print head, a pivot for pivotally mounting the mounting member, spring means including a first spring for urging the mounting member and the print head about the pivot toward the printing position, the first spring means acting on the mounting member at an acute angle relative to the tangent, means including a second spring for urging the mounting member and the print head about the pivot toward the printing position, and the second spring means acting on the mounting member at an angle greater than the acute angle.

* * * * *